US005441151A

United States Patent [19]

Billingham

[11] Patent Number: 5,441,151

[45] Date of Patent: Aug. 15, 1995

[54] STORAGE SYSTEM

[76] Inventor: Paul R. Billingham, 22 Heathfield Terrace, Chiswick, London W4 4JE, England

[21] Appl. No.: 289,443

[22] Filed: Aug. 11, 1994

Related U.S. Application Data

[63] Continuation of Ser. No. 988,118, filed as PCT/GB90/02010, Dec. 21, 1990, abandoned.

[30] Foreign Application Priority Data

Jul. 4, 1990 [GB] United Kingdom ..... 9014837

[51] Int. Cl.[6] ..... B65D 85/00; B65D 21/00; B65D 21/02

[52] U.S. Cl. ..... 206/425; 206/503; 206/504; 220/23.4; 220/528; 229/167; 229/178

[58] Field of Search ..... 206/425, 503, 504; 220/23.4, 23.83, 4.23, 339, 523, 528, 529, 552; 229/167, 178; 312/111, 107

[56] References Cited

U.S. PATENT DOCUMENTS

| | | | |
|---|---|---|---|
| 1,179,258 | 4/1916 | Willard | 220/339 |
| 1,966,672 | 7/1934 | Lang | 220/23.4 |
| 1,974,552 | 9/1934 | Wallbank | 229/178 |
| 2,135,401 | 11/1938 | Kiff | 206/503 |
| 2,454,307 | 11/1948 | Cooley | 220/23.4 |
| 2,746,109 | 5/1956 | Budai | 312/111 |
| 3,179,278 | 4/1965 | Cohen | 220/529 |
| 3,238,004 | 3/1966 | Goebel | 220/529 |
| 3,287,075 | 11/1966 | Batke et al. | 206/504 |
| 4,053,101 | 10/1977 | Hart, Jr. | 229/178 |
| 4,060,169 | 11/1977 | Hildebrand et al. | 229/167 |
| 4,128,167 | 12/1978 | Hogshead, III | 229/178 |
| 4,341,339 | 7/1982 | Zore | 229/167 |
| 4,744,487 | 5/1988 | Welborn . | |
| 4,817,861 | 4/1989 | Henrikson | 206/425 |

FOREIGN PATENT DOCUMENTS

| | | | |
|---|---|---|---|
| 1761138 | 4/1971 | Germany . | |
| 2124160 | 11/1972 | Germany . | |
| 2847726 | 7/1979 | Germany . | |
| 3307994 | 9/1984 | Germany . | |
| 222953 | 11/1972 | United Kingdom . | |
| 2148256 | 5/1985 | United Kingdom . | |
| 9005643 | 5/1990 | WIPO | 206/425 |

*Primary Examiner*—Steven N. Meyers
*Assistant Examiner*—Marie Denise Patterson
*Attorney, Agent, or Firm*—Fay, Sharpe, Beall, Fagan, Minnich & McKee

[57] ABSTRACT

A storage box for documents, files or the like, and having a generally rectangular body (2) with one open side for access which is sloped or angled, relative to the opposite side. Three of the side edges of the opening are also inwardly flanged, and a slightly smaller lid (4) of co-operating shape is hinged to the fourth edge (6) or to the edge of an insert (30) which divides the interior into sections. The insert may divide the interior into two or more such sections depending on the application.

10 Claims, 10 Drawing Sheets

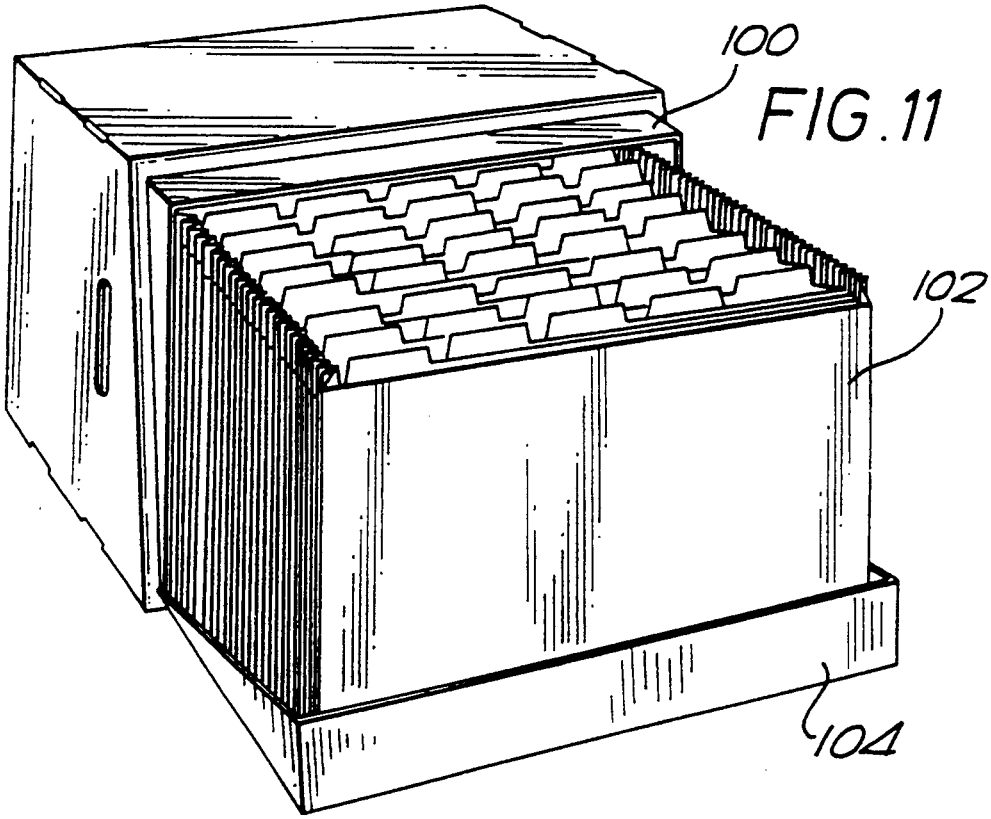
FIG. 11
FIG. 12
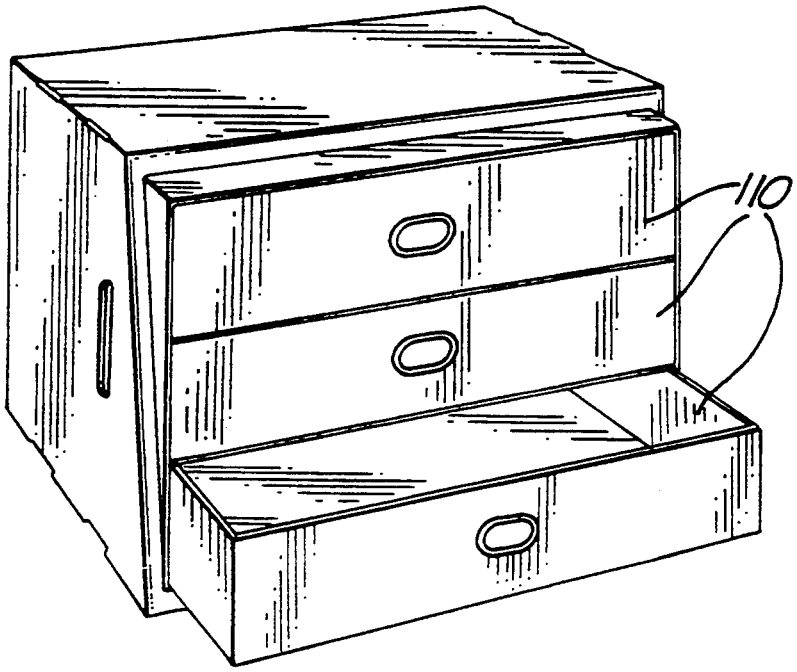

STORAGE SYSTEM

This application is a continuation of application Ser. No. 07/988,118 which was filed as PCT/GB90/02010, Dec. 21, 1990, now abandoned.

This invention relates to storage systems and containers, and particularly to storage boxes suitable inter alia for the archival filing of documents and folders.

Archival filing boxes of various kinds are already known, and the most common type of simple filing box has a removable cover or lid, and may be stacked up with other similar boxes, when it has been filled with files and the lid closed. However, it is then impossible to reach stored files in the lower part of the stack, without taking other boxes off the top of the stack so as to enable the lower boxes to be opened. More complex types of archival filing systems, which do allow access to the contents of intermediate boxes in a stack, may for example be provided with internal "drawers" which have to be pulled out to a considerable extent, to reach files stored at the back of the drawers, and it is difficult to construct containers of this kind cheaply whilst at the same time making them sufficiently strong for normal use.

Accordingly, the present invention seeks to provide a storage system comprising boxes which can be easily constructed from a cheap material such as corrugated cardboard, and are sufficiently rigid to withstand repeated opening and closing, and removal and replacement of the contents, whilst at the same time being easily and securely "stackable" to form a rigid array of containers.

Accordingly, the present invention provides a storage box having a generally rectangular body, one side of which comprises an opening for access to the interior of the box, and is sloped, relative to the opposite side; the said open side having inwardly flanged edges and being adapted to receive a lid having co-operating side edge walls with a complementary sloped formation, the lid being permanently or detachably connected to the box, and being made smaller in plan than the box so as to cooperate with said flanged edges to facilitate opening the box when it is stacked together with a plurality of similar boxes.

Preferably the lid is detachably connected to the box and is adapted to hinge about one edge of the opening, and has a rectangular edge wall member opposite the hinged edge, and triangular side edge wall members, so as to form a complementary shape to the open side of the box.

Preferably, in order to facilitate stacking of the boxes together in rigid arrays, each box is provided with a slot or slots extending along at least one of its side edges, so that when two boxes are arranged with their corresponding walls in abutment, they can be held together by means of a suitably shaped retaining clip inserted into the aligned slot or slots.

The invention also extends to an assembly of such boxes in which adjacent boxes are held together by at least one retaining clip, the or each clip comprising a pair of generally parallel, flat leg portions each of which is adapted to engage with one of the slots, and an interconnecting body portion providing a grip which enables the clip to be held by an operator. Preferably, the clip is generally "butterfly" shaped, so that it can be rotated or slid laterally in the slot after insertion, so as to lock it into position.

In a preferred form of the invention, the storage box further includes a slidable insert, adapted to be inserted through the open side of the box, and also being open at least on the side which co-operates with the box opening, the insert being substantially rectangular on all its outer sides, and conforming to the largest internal dimensions of the box, so that three of its edges stand proud of the sloped open side of the box after insertion. In this way the lid can fit over the projecting edges of the insert. In a preferred embodiment of the invention, the hinged lid is hinged to the fourth edge of the insert, rather than to the corresponding edge of the box, so that the insert and lid can be removed together.

The insert may have various different internal formations such as partitions or drawers.

Some embodiments of the invention will now be described by way of example with reference to the accompanying drawings, in which.

Figure 1:
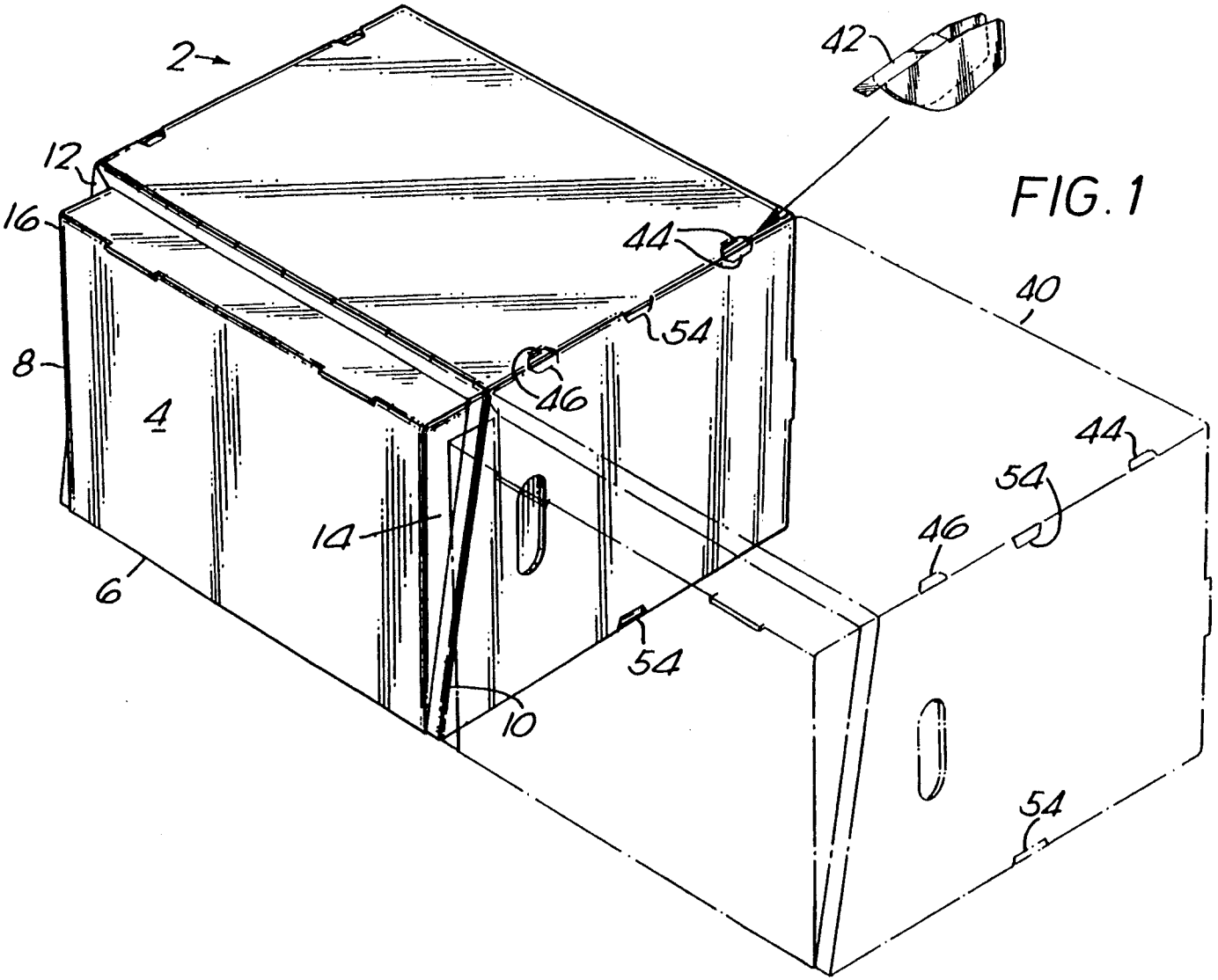
FIG. 1 is a front perspective view from above and one side of a box comprising a first embodiment of the invention and also indicating how a second box may be attached to the first.
Figure 2:
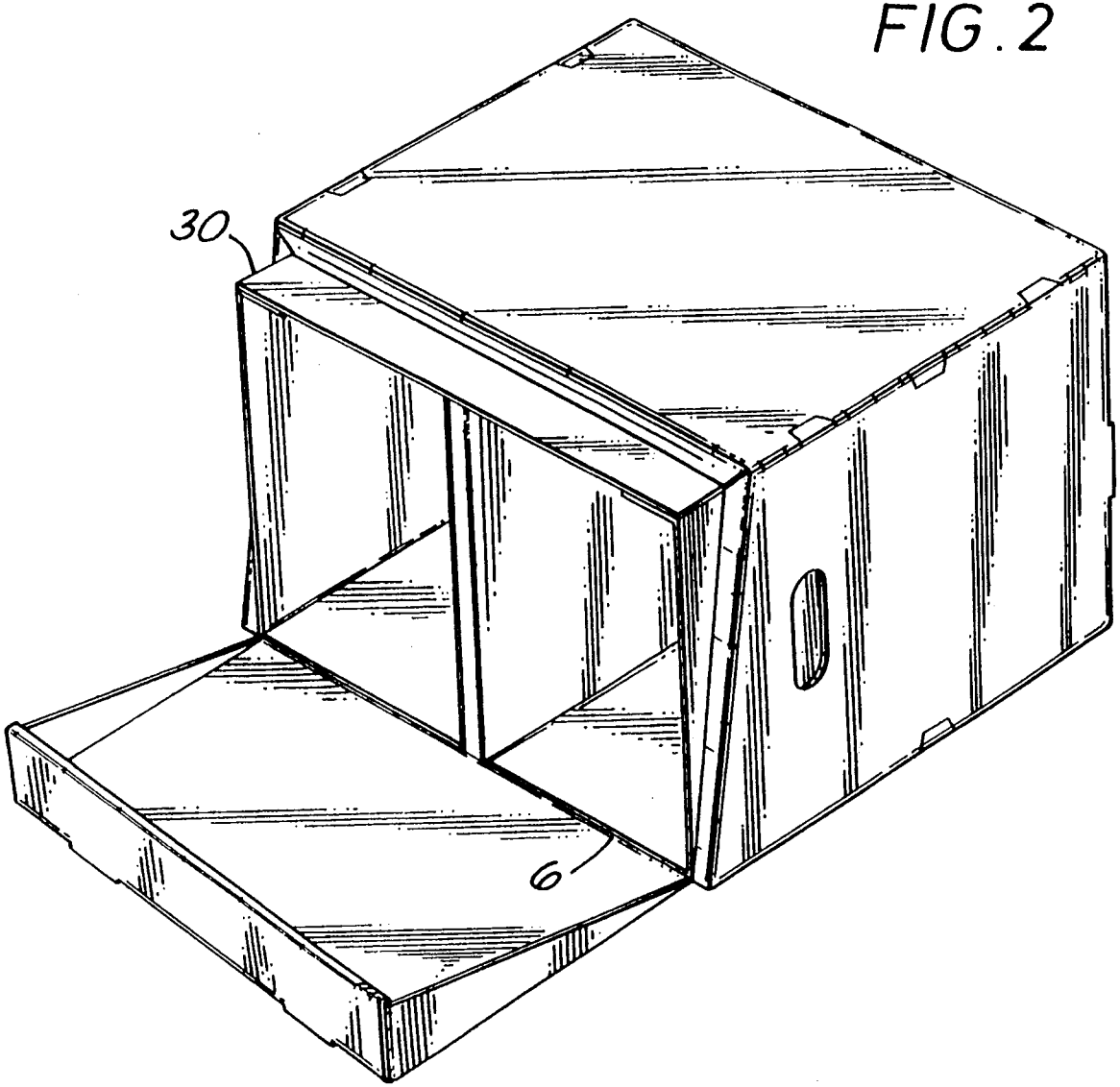
FIG. 2 is a front perspective view, corresponding to the view of FIG. 1, but showing the box in its open condition.
Figure 6:
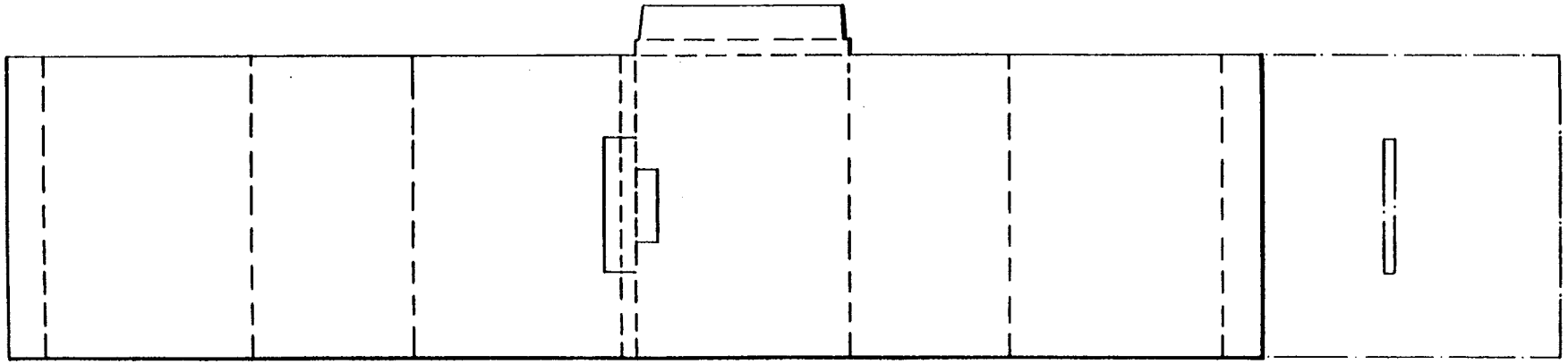
Figure 4C:
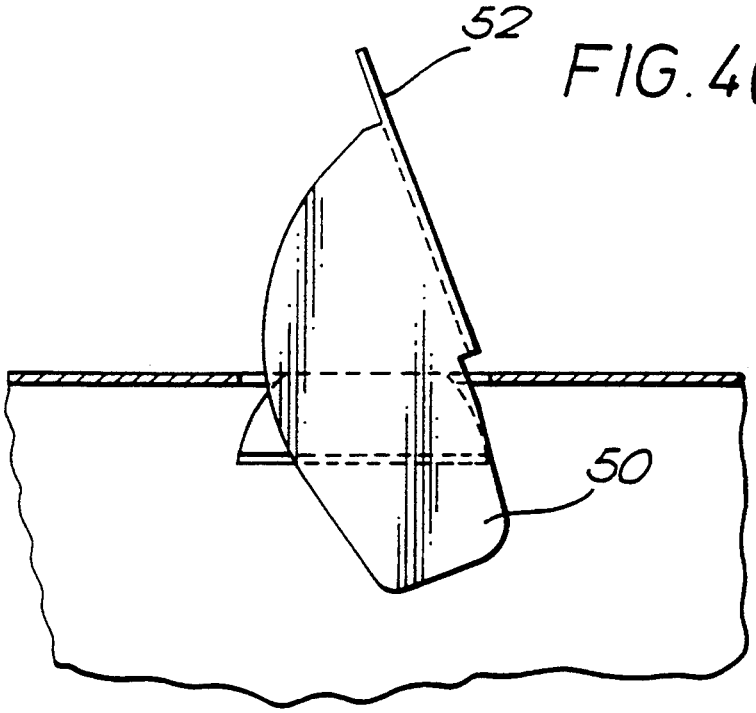
Figure 4D:
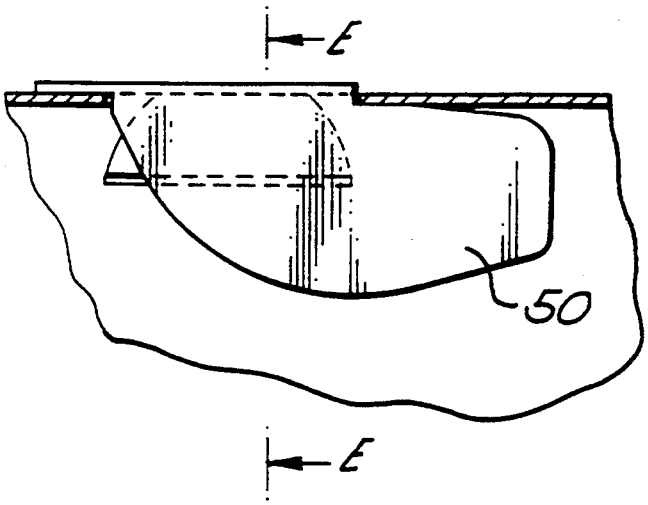
Figure 4E:
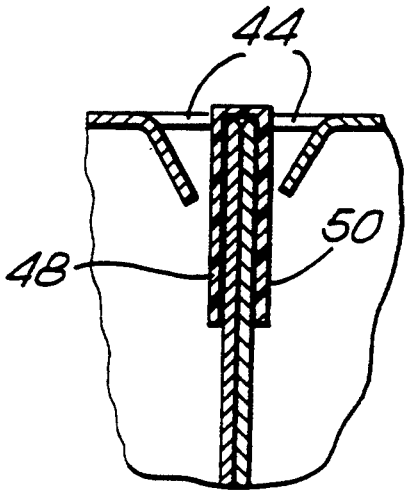
Figure 5:
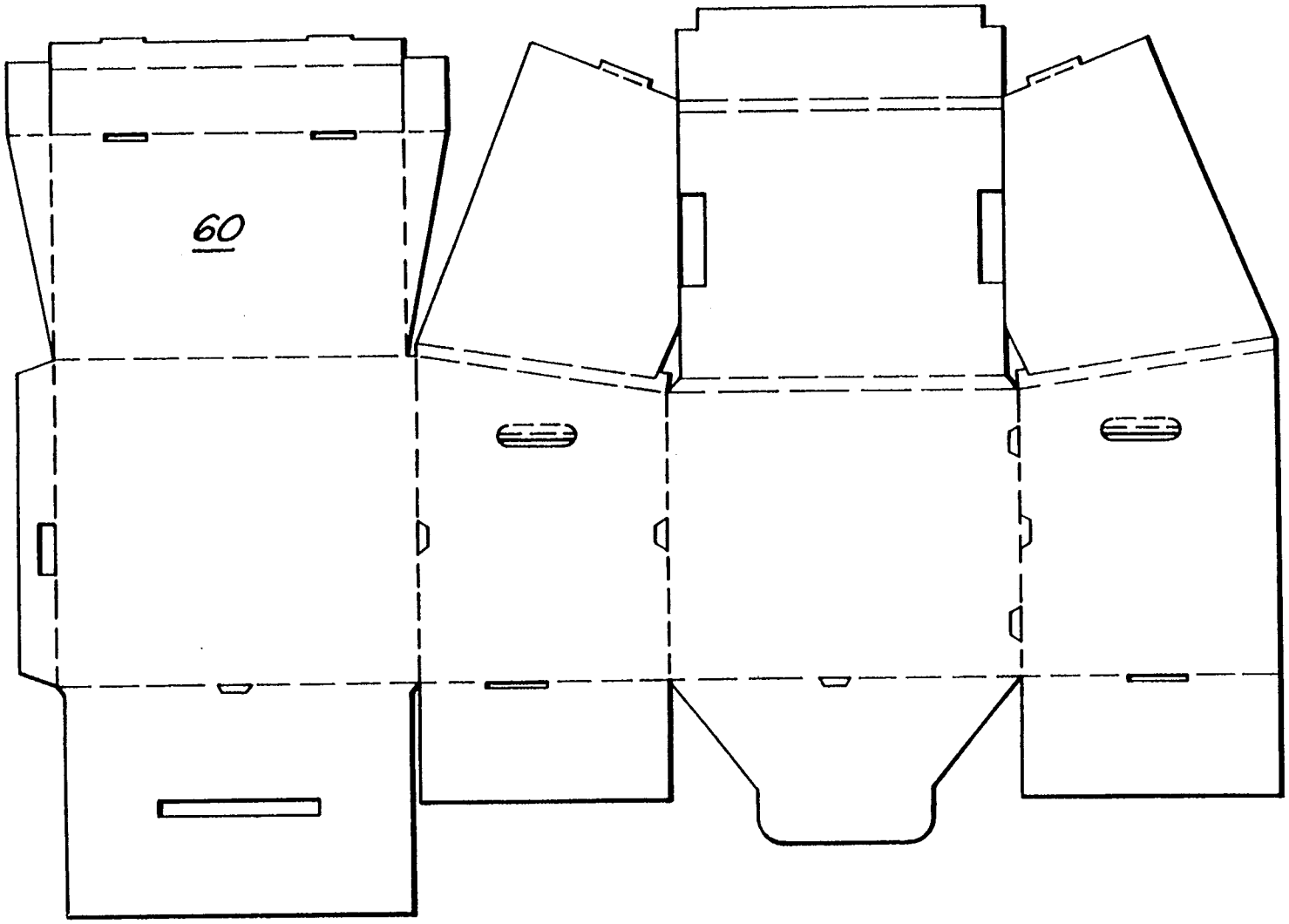
Figure 7:
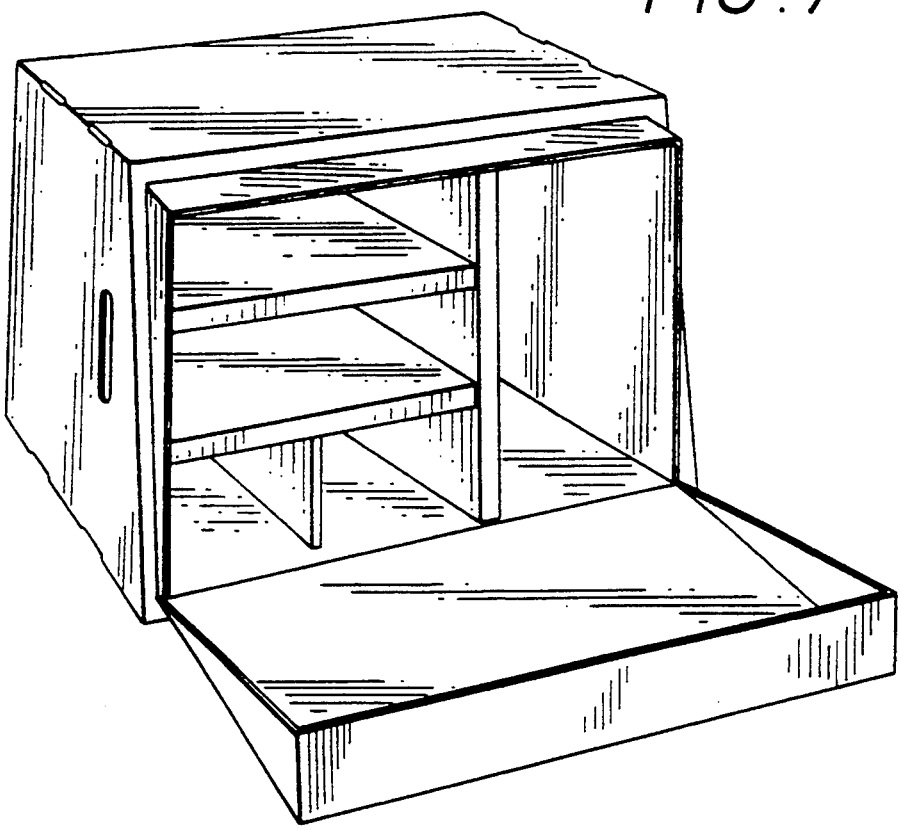
Figure 8:
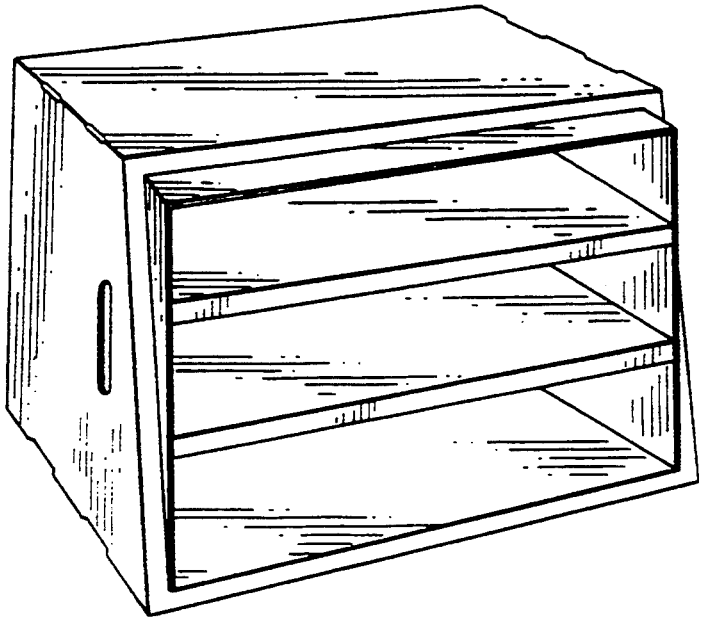
Figure 9:
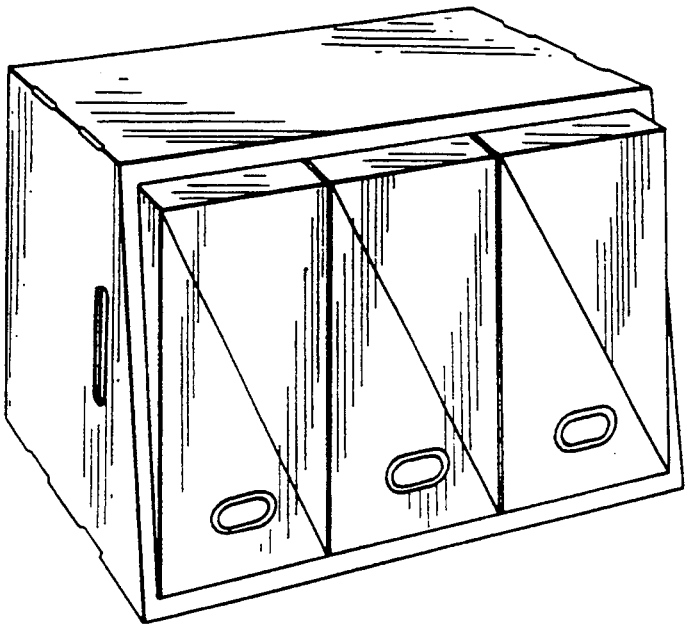
Figure 10:
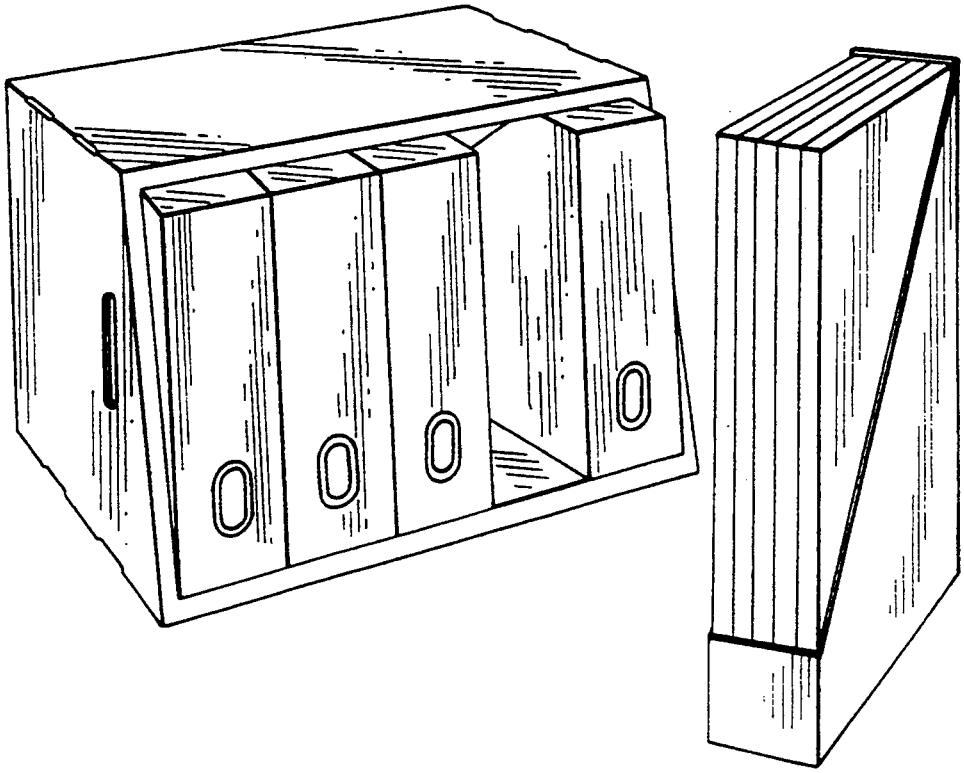
Figure 13:
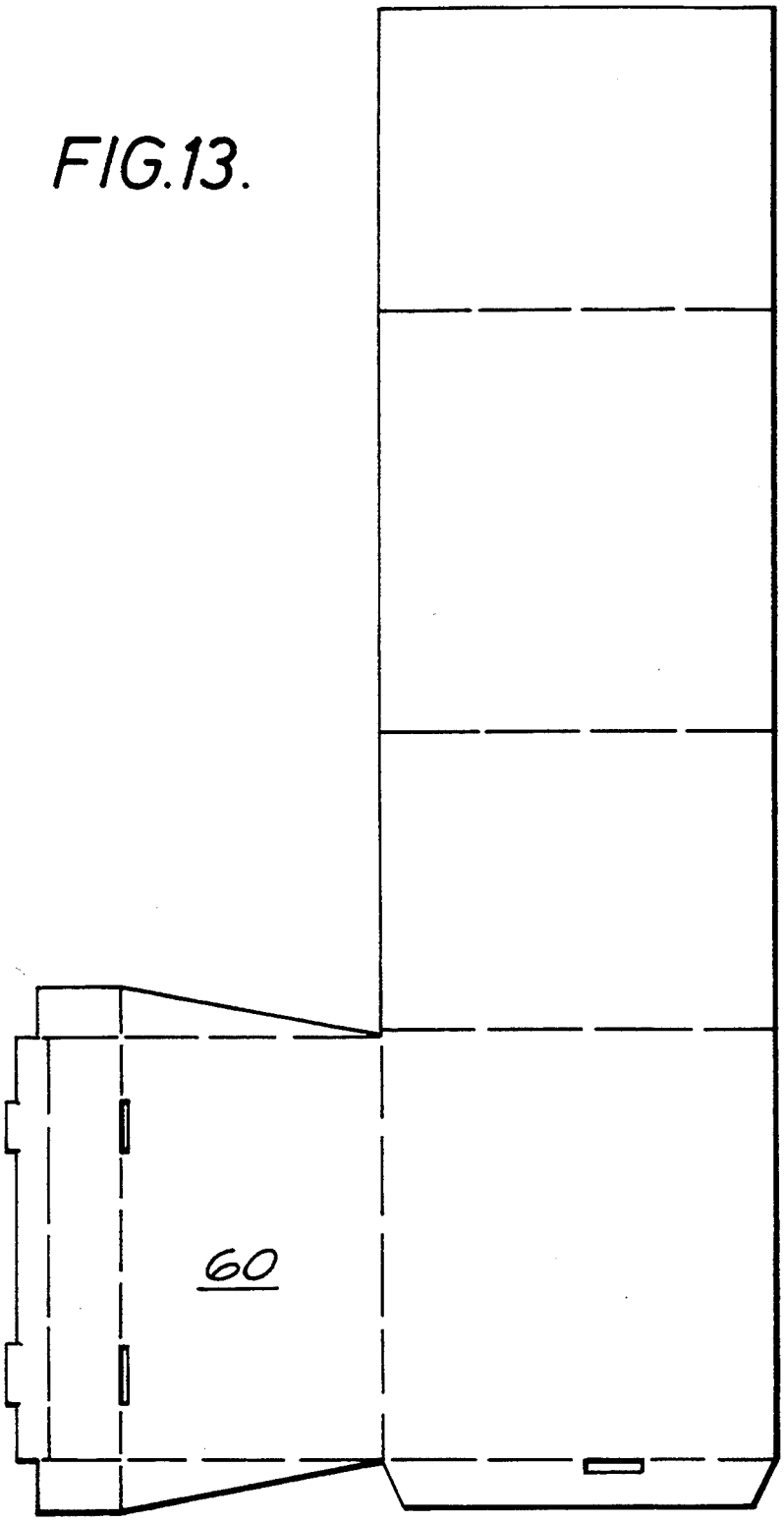

FIGS. 4(*a*), 4(*b*), 4(*c*), 4(*d*), and 4(*e*) show a retaining clip and illustrates how it is used to hold boxes together next to one another;

FIG. 5 shows a blank used for making the box of FIG. 1;

FIG. 6 shows a blank for a slidable insert for the box of FIG. 2;

FIGS. 7 and 8 show other possible types of inserts;

FIGS. 9 and 10 illustrate the use of the box for storing box files;

FIG. 11 illustrates an arrangement of the box with a concertina file;

FIG. 12 illustrates an arrangement which includes drawers in the insert; and FIG. 13 illustrates another blank for a slidable insert for the box of FIG. 2.

Referring to FIG. 1, the box comprises a rectangular container 2, having a hinged lid 4 on one side. The lid 4 is hinged to the box along one edge 6, and as will be apparent from the figure, the length and width of the lid along the edge 6 and edge 8 indicated in the drawing, are both slightly less than the corresponding dimensions of the box, and in addition the face of the box carrying the lid is inwardly flanged and is also sloped back slightly from the hinged edge, along its opposite sides 10 and 12. The corresponding sides 14 and 16 of the lid are triangular in shape, with a corresponding angle, so that the top of the lid 4 is parallel with the base of the box when the lid is closed.

The effect of this arrangement is that the edges of the lid are inset from the corresponding edges of the box, and thus when a series of boxes are stacked one on top of another, or next to one another, the user can still easily grasp the edges of the lid to open it. The open configuration is illustrated in FIG. 2, from which it will be seen that, since the hinged edge 6 is at the extreme edge of the lid and the box, the process of opening the lid does not interfere with a lower box in the same stack when the boxes are stacked together. FIG. 2 also illustrates the preferred form of insert for the box, which is adapted to receive folders in a "lateral filing" type of arrangement, and it will be seen that the insert 30 provides a flange extending from the opening of the box, against which the lid 4 is closed in use. In the preferred form of the invention, the insert can be slid in and out of the box, and in addition the edge 6 of the lid may be hinged to the corresponding edge of the insert rather than to the corresponding edge of the box itself so that the insert and lid can be removed together. This leaves a simple open sided box for filing in situations where a lid is not required.

Referring once again to FIG. 1, a second box 40 may be held in side-by-side relation to the first by inserting a special retaining clip 42 (shown somewhat enlarged in the figure) into slots 44 at the adjacent edges of the two boxes. As shown in the drawing, two sets of slots 44 and 46 are provided along the top side edges of the boxes, respectively near the rear and front walls, with their entries in the top surface. The construction and manner of insertion of the retaining clip 42 is illustrated in FIG. 4. FIG. 4(*a*) shows a blank (for example of stiff but "foldable" plastic) having two "leg" portions 48 and 50 which are each bent in the same direction at right angles to the central strip like body 52, so as to form a clip as shown in cross-section in FIG. 4(*b*). This is then inserted into the slots 44 for example, in the orientation illustrated in FIG. 4(*c*) and then rotated to the position of FIG. 4(*d*) so as to be effectively locked in position. FIG. 4(*e*) shows a cross-section on the lines E—E of FIG. 4(*d*), showing how the legs 48, 50 of the clip hold the adjacent side walls of the two boxes between them.

Figure 3:
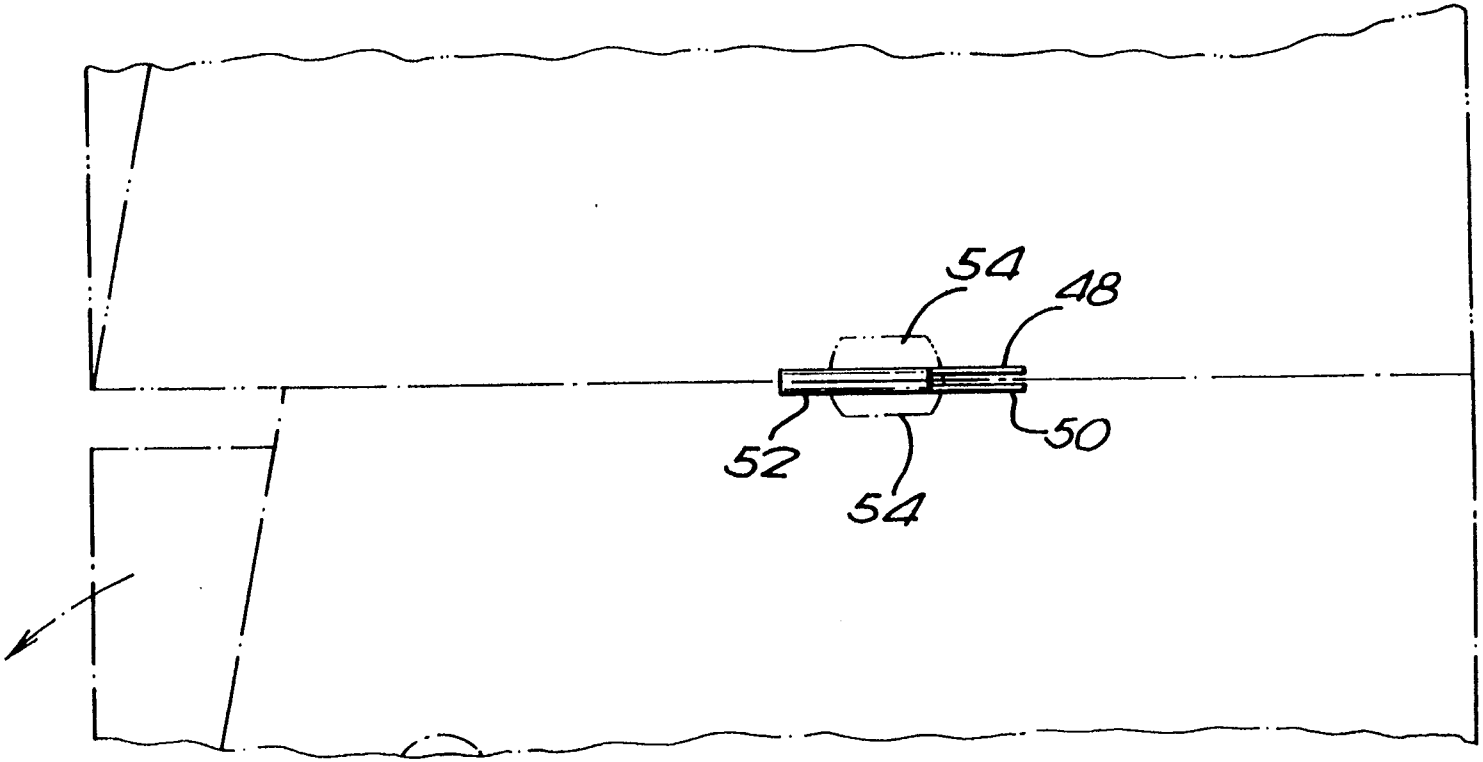
FIG. 3 illustrates the preferred method of interconnecting boxes to form a stack.
Figure 4B:
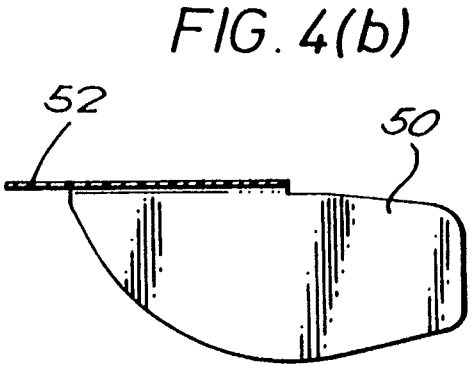
Figure 4A:
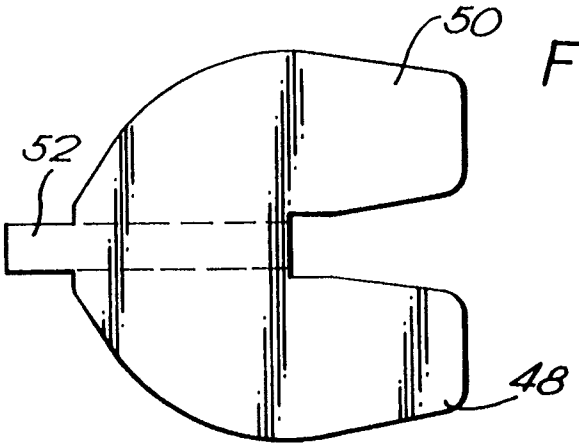

As shown in FIGS. 1 and 3, the edges of the boxes may also be provided with horizontally-extending slots 54 to allow boxes to be similarly secured together in a superimposed relationship so that large arrays can be built up. In addition the rear edges of the boxes can be suitably slotted to allow boxes to be arranged back-to-back.

FIG. 5 illustrates a possible configuration of a blank for making up the box while FIG. 6 illustrates a blank for the insert 30. As shown the lid structure is formed by flap 60 attached to the box blank. However, as mentioned above, the lid may be attached to the corresponding edge of the insert so that the lid and insert can be removed together. Such a construction is illustrated in FIG. 13 wherein the flap 60 is shown as being hingedly secured to a back wall of the insert. The bottom wall portions of the insert are not shown for the sake of simplicity.

The arrangement illustrated and described above is particularly useful as an archival file storage system but it will be appreciated that the box(es) of the invention may be used for many other purposes. To this end more complex inserts may be provided to divide the interior into smaller compartments to suit the articles to be stored. Possible exemplary arrangements are shown in FIGS. 7 and 8. As another alternative the insert may be plain, i.e. with no subdividing partitions, so that box files can be stored in it as illustrated in FIGS. 9 and 10.

A further arrangement illustrated in FIG. 11, includes a plain insert 100 with a hinged lid 104, which is adapted to receive a concertina file 102 so that the file can be extended out onto the open lid for access to the contents.

As shown in FIG. 12, another possible form of internal storage comprises a set of slidable drawers 110 fitted into the insert, which may optionally be separated by horizontal partitions in the insert (not shown).

I claim:

1. A storage box comprising:

a generally rectangular body, one side of which comprises an opening for access to an interior of said body, said body being so shaped that when a side comprising said opening is uppermost, said side is sloped with a single pitch, relative to a base of said body;

a lid operatively secured to said body and closing said body side comprising said opening, wherein said body side comprising said opening has three edges which comprise inward flanges;

wherein said lid is smaller in size than said body side comprising said opening, said lid comprising dependent side walls so shaped that when said lid is closed its top surface is parallel to said base; and, wherein free edges of said lid side walls are inset relative to said inward flanges of said opening so that when a plurality of storage boxes are stacked together on their sides an access opening is defined between adjacent boxes to allow a user to grasp a side wall or a top wall of a lid of each box and open such box without contacting adjacent boxes.

2. A storage box according to claim 1 further comprising a slidable insert, which is selectively insertable through the open side of the body, said insert also being open at least on the side which corresponds to the body opening, the insert being substantially rectangular on all its outer sides, and conforming to the largest internal dimensions of the body, so that three of its edges extend past the sloped open side of the body after insertion.

3. A storage box according to claim 2 in which the lid is hinged to a fourth edge of the insert, so that the insert and lid can be removed together.

4. A storage box according to claim 2 in which said insert comprises one or more internal partitions so as to divide the interior into compartments.

5. A storage box according to claim 2 further comprising at least one slidable drawer mounted in the insert.

6. A storage box according to claim 1 further comprising a cooperating concertina file selectively insertable in said body opening wherein the file can be opened out to extend over an inner surface of the lid, when the box is open.

7. A storage box according to claim 1 further comprising a slot extending along a side edge of the body, and a retaining clip, a second box having a slot extending along a side edge of a body thereof, wherein when said boxes are arranged with their corresponding walls in abutment with the corresponding slots suitably aligned, they can be held together by said retaining clip inserted into the aligned slot of each box.

8. An assembly of at least two storage boxes according to claim 7, in which adjacent boxes are held together by at least one retaining clip, the clip comprising a pair of generally parallel, flat leg portions each of which engages one of the slots, and an interconnecting body portion providing a grip which enables the clip to be held by an operator.

9. An assembly according to claim 8 wherein said clip is generally "butterfly" shaped so that each of said pair of legs is longer than said interconnecting body portion, so that said clip can be rotated or slid laterally in the slot after insertion, so as to lock it into position.

10. A storage construction comprising:

a pair of side walls, a front wall, a back wall and a bottom wall, said walls cooperating to form a generally rectangular box having a generally rectangular opening for access to a hollow interior of the box; and, a slidable insert which is selectively insertable through said box opening into said hollow interior, said insert comprising:

a pair of side walls, a front wall, a back wall, a bottom wall, wherein said side walls, front wall, back wall and bottom wall cooperate to form a generally rectangular body, and a lid hinged to said slidable insert back wall; and, wherein said lid is smaller in size than said bottom wall of said box so that when a plurality of said boxes are stacked together on their sides, a lid of each insert can be opened without contacting adjacent boxes.

* * * * *